US012616306B2

(12) United States Patent
Zwick et al.

(10) Patent No.: US 12,616,306 B2
(45) Date of Patent: May 5, 2026

(54) SEAT ELEMENT

(71) Applicants: Roland Zwick, Berlin (DE); Carola Zwick, Berlin (DE); Burkhard Schmitz, Berlin (DE)

(72) Inventors: Roland Zwick, Berlin (DE); Carola Zwick, Berlin (DE); Burkhard Schmitz, Berlin (DE)

( * ) Notice: Subject to any disclaimer, the term of this patent is extended or adjusted under 35 U.S.C. 154(b) by 224 days.

(21) Appl. No.: 18/572,387

(22) PCT Filed: Jun. 24, 2022

(86) PCT No.: PCT/EP2022/067389

§ 371 (c)(1),
(2) Date: Dec. 20, 2023

(87) PCT Pub. No.: WO2022/269055

PCT Pub. Date: Dec. 28, 2022

(65) Prior Publication Data

US 2024/0285080 A1 Aug. 29, 2024

(30) Foreign Application Priority Data

Jun. 24, 2021 (DE) ..... 10 2021 116 383

(51) Int. Cl.
*A47C 5/06* (2006.01)
*A47C 7/28* (2006.01)
*A47C 7/38* (2006.01)

(52) U.S. Cl.
CPC ..... *A47C 7/282* (2013.01); *A47C 5/06* (2013.01); *A47C 7/38* (2013.01)

(58) Field of Classification Search
CPC ..... A47C 7/282; A47C 7/345; A47C 5/06
See application file for complete search history.

(56) References Cited

U.S. PATENT DOCUMENTS 3,208,794 A * 9/1965 Gunn ..... A47C 31/11 297/284.2 X
3,258,259 A * 6/1966 Bohlin ..... A47C 7/22 297/284.2 X (Continued)

FOREIGN PATENT DOCUMENTS

DE 69334123 11/2007
DE 102009059699 A1 8/2010

(Continued)

OTHER PUBLICATIONS

International Search Report and Written Opinion for PCT Application No. PCT/EP2022/067389, Dated Sep. 20, 2022, 13 Pages including English Translation.

(Continued)

*Primary Examiner* — Rodney B White
(74) *Attorney, Agent, or Firm* — Christopher J. Volkmann; KELLY, HOLT & CHRISTENSON PLLC

(57) ABSTRACT

A seat element includes a carrier frame and supporting surfaces. The carrier frame comprises a left-hand sidepiece and a right-hand sidepiece. The supporting surfaces are configured as the seat surface and back surface. At least one of the supporting surfaces comprises a cover element, wherein the cover element comprises a fabric and is supported on the left-hand sidepiece and on the right-hand sidepiece of the carrier frame. The seat element comprises actuators and the cover element is supported on the left-hand sidepiece and/or on the right-hand sidepiece by means of in each case at least one of the actuator, such that a level of tensioning to which the fabric of the cover element is subjected when the actuator has been activated is greater than a level of tensioning to which the fabric of the cover element is subjected when the actuator has been deactivated.

19 Claims, 6 Drawing Sheets

(56) References Cited

U.S. PATENT DOCUMENTS

| | | | | |
|---|---|---|---|---|
| 3,289,220 | A * | 12/1966 | Grimshaw | A47C 23/20 297/452.56 X |
| 5,797,652 | A * | 8/1998 | Darbyshire | B60N 2/66 297/284.2 X |
| 5,867,852 | A * | 2/1999 | Knight | A47C 23/28 24/270 |
| 6,254,186 | B1 * | 7/2001 | Falzon | B60N 2/6673 297/284.2 X |
| 7,128,372 | B2 * | 10/2006 | Farquhar | B60N 2/66 297/284.2 X |
| 7,517,024 | B2 * | 4/2009 | Cvek | A47C 7/282 297/284.2 X |
| 7,614,694 | B2 * | 11/2009 | Forgatsch | B64D 11/06 297/284.2 X |
| 8,622,472 | B2 * | 1/2014 | Rajaratnam | A47C 7/282 297/284.2 X |
| 9,861,201 | B2 | 1/2018 | Battey et al. | |
| 10,159,351 | B1 | 12/2018 | Alexander et al. | |
| 10,874,220 | B2 * | 12/2020 | Aldrich | B29C 55/165 |
| 11,825,957 | B2 * | 11/2023 | Aldrich | D03D 1/00 |
| 12,215,445 | B2 * | 2/2025 | McGraw | A47C 7/282 |
| 12,274,373 | B2 * | 4/2025 | Birks | A47C 7/462 |
| 2005/0242652 | A1 * | 11/2005 | Kepler | B60N 2/7094 297/452.56 X |
| 2007/0267905 | A1 | 11/2007 | Cvek | |

FOREIGN PATENT DOCUMENTS

| | | |
|---|---|---|
| DE | 202015008090 | 12/2015 |
| DE | 102020134186 | 3/2022 |
| EP | 1619072 | 5/2010 |
| GB | 2569289 A | 6/2019 |
| WO | 2008031374 | 3/2008 |

OTHER PUBLICATIONS

Search Report for German Application No. 102021116383.8, Dated Apr. 14, 2022, 7 pages.

International Preliminary Report on Patentability for International Application No. PCT/EP2022/067389, dated Jan. 4, 2024, 17 pages.

* cited by examiner

SEAT ELEMENT

CROSS-REFERENCES TO RELATED APPLICATIONS

This Application is a Section 371 National Stage Application of International Application No. PCT/EP2022/067389, filed Jun. 24, 2022, and published as WO 2022/269055 A1 on Dec. 29, 2022, and claims priority to German Application No. 102021116383.8, filed Jun. 24, 2021. The contents of these applications are hereby incorporated by reference in their entirety.

DETAILED DESCRIPTION

Figure 1:
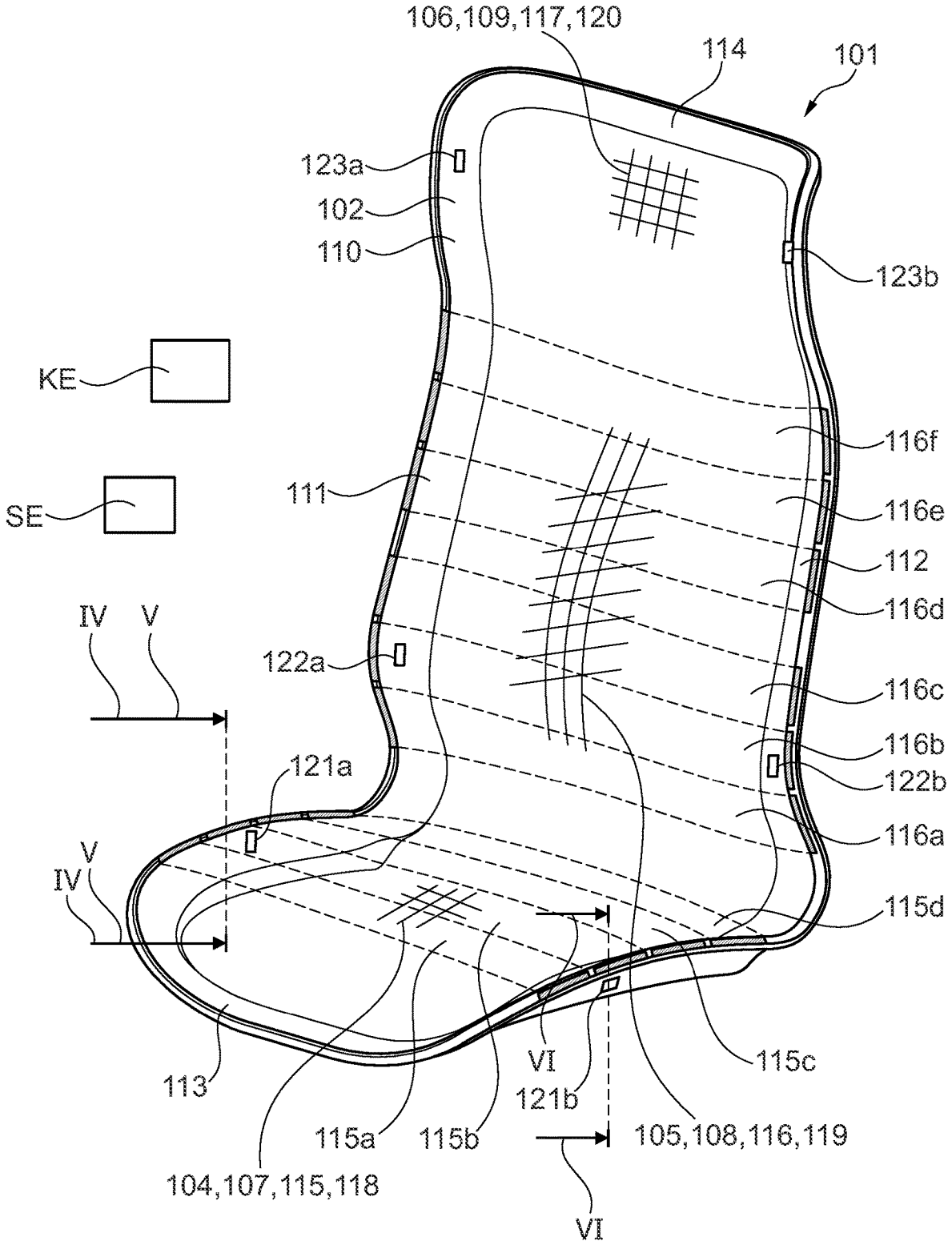
FIG. 1 shows a seat element according to one example, in a perspective view.

The present disclosure relates to a seat element and a method according to the preamble of claim 1 or 18.

A seat element which comprises a carrier frame and supporting surfaces is disclosed in DE 693 34 123 T2, wherein the carrier frame comprises a left-hand sidepiece and a right-hand sidepiece, wherein at least one of the supporting surfaces comprises a cover element and wherein the cover element comprises a fabric and is supported on the left-hand sidepiece and on the right-hand sidepiece of the carrier frame.

An object of the present disclosure is to develop a seat element, the cover element thereof being individually adaptable to the user.

Proceeding from the features of the preamble of claim 1 or 18, this object is achieved by the characterizing features of claim 1. Advantageous and expedient developments are specified in the dependent claims.

The seat element according to one example comprises a carrier frame and supporting surfaces, wherein the carrier frame comprises a left-hand sidepiece and a right-hand sidepiece, wherein the supporting surfaces are configured, in particular, as the seat surface and back surface, wherein at least one of the supporting surfaces comprises a cover element, wherein the cover element comprises a fabric and is supported on the left-hand sidepiece and on the right-hand sidepiece of the carrier frame, wherein the seat element comprises actuators and wherein the cover element is supported on the left-hand sidepiece and/or on the right-hand sidepiece by means of in each case at least one of the actuators, such that a level of tensioning to which the fabric of the cover element is subjected when the actuator has been activated is greater than a level of tensioning to which the fabric of the cover element is subjected when the actuator has been deactivated. Such a seat element makes it possible to adjust one or more cover elements, in terms of the level of tensioning of its fabric, individually to a user so that the seating furniture has greater seating comfort for the user when it is adapted to the user by means of the actuators.

It is further provided that the fabric of the cover element comprises at least one weft thread consisting, in particular, of plastics and warp threads consisting, in particular, of plastics, wherein the warp threads run in the direction of the left-hand sidepiece and the right-hand sidepiece and wherein the at least one weft thread runs transversely to the warp threads in a central region of the cover element. Such a cover element can be easily tensioned via the weft thread/weft threads.

It is also provided that the cover element is connected to the at least one actuator by a plurality of path sections of the at least one weft thread. As a result, it is possible to tension the cover element in a strip-shaped region while avoiding excessively stressing the weft thread.

It is also provided to configure the cover element as a single-layer supporting device, in particular in the region of the fabric, or to configure the cover element as a two-layer supporting device, in particular in the region of the fabric, wherein an upper layer of the supporting device and a lower layer of the supporting device are spaced apart from one another between the left-hand sidepiece and the right-hand sidepiece, such that a cavity is formed between the two layers and the cover element is configured as a tubular casing. A cover element which is configured in a single layer permits a lightweight and space-saving configuration of the seat element. A cover element which is configured in two layers permits a particularly simple construction of the seat element, since due to its tubular shape the cover element can be supported on the sidepieces without further aids.

It is further provided to arrange the actuators either exclusively on the left-hand sidepiece or exclusively on the right-hand sidepiece or on both sidepieces or spaced apart from the sidepieces. By an exclusively one-sided arrangement, only one of the two sidepieces has to be adapted to the actuators. A two-sided arrangement of the actuators provides the advantage that, with the same number of actuators, more constructional space is available for the individual actuator. Finally, an arrangement of the actuators spaced apart from the sidepieces provides the advantage that the seat element can be designed to be narrow in the region of both sidepieces.

It is further provided to design and arrange adjacent to one another the clamping bodies of at least two actuators such that the clamping actions thereof are oriented in the same direction and are added together, or to design and arrange adjacent to one another the clamping bodies of at least two actuators such that the clamping actions thereof are oriented in different directions and are superimposed. As a result, longer clamping paths and/or additional movements can be achieved by multiple use of clamping bodies or actuators of the same construction.

It is also provided to configure the cover element with a plurality of strip-shaped portions running between the left-hand sidepiece and the right-hand sidepiece and to assign in each case at least two of these portions to at least one of the actuators. As a result, larger surfaces of the cover element can be individually adapted.

It is further provided to equip the actuator with a clamping body, wherein the cover element is either directly connected to the clamping body or is indirectly connected by the interposition of a force transmission element which is configured, in particular, as a clamping slide, wherein it is provided, in particular, that for clamping the cover element the actuator pushes with a compressive force onto the cover element and preferably onto an edge of the cover element, or wherein it is provided, in particular, that for tensioning the cover element the actuator pulls with a tensile force on the cover element and preferably on an edge of the cover element. This results in the cover element being able to be tensioned on differently designed carrier frames.

It is also provided to receive the force transmission element and the actuator, or only the actuator, on the left-hand sidepiece and, in particular, in a recess of the left-hand sidepiece or on the right-hand sidepiece and, in particular, in a recess of the right-hand sidepiece such that a clamping force is generated thereby on the cover element, while being supported on the left-hand or right-hand sidepiece. A reliable introduction of force into the sidepiece is ensured by such an integration.

It is also provided to guide the force transmission element, in particular, in a linearly displaceable manner on the left-hand sidepiece or on the right-hand sidepiece. As a result, the level of tensioning can be changed in a reproducible manner.

It is further provided

- to equip at least one of the actuators and preferably all of the actuators with a resilient hollow body which can be changed in terms of shape by supplying or draining off a fluid, and/or
- to equip at least one of the actuators and preferably all of the actuators with a single eccentric or a double eccentric which can be adjusted by hand and/or automatically, and/or
- to equip at least one of the actuators and preferably all of the actuators with a spindle which can be adjusted by hand or automatically. Actuators which are configured in such a manner are cost-effective and operate in a reliable manner.

It is also provided to generate a tensioning of the cover element by a tensile force or a compressive force which runs in a plane defined by the cover element and/or to generate a tensioning of the cover element by a deformation of the cover element. As a result, the cover element can be adjusted individually to the user and can also achieve a deformation by which an additional customization is possible.

It is also provided to equip the seat element with a further supporting surface which is configured as a headrest surface. As a result, it is possible to provide additional comfort.

It is further provided to configure the carrier frame, which forms the sidepieces for the supporting surfaces, as a one-piece carrier frame, wherein the carrier frame is configured, in particular, as an annular closed profile ring, the sidepieces thereof being connected by a lower transverse piece and an upper transverse piece. Such a carrier frame, when of lightweight design, is also well-suited for absorbing forces which occur when the cover element is tensioned.

It is also provided to arrange and configure the actuator such that the cover element is lifted from the carrier frame when the actuator has been activated further than the cover element is lifted from the carrier frame when the actuator has been deactivated. As a result, a lowering function or a lifting function or an inclining function can be implemented in the seat region. As a result, support and load relief functions can be implemented in the back region and/or head region, the seat element in the back and/or head region being able to be adapted thereby individually to the wishes of the user.

It is further provided to configure the seat element, in particular, as a seat element of an office chair or a vehicle seat, wherein it is also provided, in particular, to form a flexible zone between the seat surface and the back surface by the left-hand sidepiece and the right-hand sidepiece. As a result, the advantages of the seat element can be used in different fields of application.

Finally it is provided to equip the seat element with a control device for a plurality of actuators and to equip the seat element with a sensor device, wherein the control device activates at least one of the actuators in response to a signal from the sensor element, in particular after a predetermined time and in particular for a predetermined time period, in particular abruptly. As a result, accidents can be avoided and the effects of an accident can be reduced thereby. If the sensor identifies, for example, the tilting of an office chair, in which the seat element is installed, a reaction of the user which can prevent the tilting can be triggered by an impulse emitted by an actuator at a suitable point. If the sensor receives a signal for an imminent collision or a collision which is already occurring, for example from other sensors, if the seat element is installed in a vehicle seat, the control device can activate an individual actuator or a plurality of actuators in a targeted manner in order to move the user into a position by which the consequences of the accident are reduced, or in order to adjust to new requirements. These adaptations can also change over the course of time, so that the seat element can actively accompany a sequence of the collision.

The method according to one example for operating a seat element which is configured according to at least one of claims 1 to 16, which comprises a control device for a plurality of actuators and which comprises a sensor device, provides to activate the control device by a signal from the sensor device such that, in particular after a predetermined time and in particular for a predetermined time period, individual actuators or groups of actuators are activated thereby, preferably at the same time or one after the other, in particular abruptly, for achieving a deformation of the fabric of the cover element of the seat element. Accidents can be avoided and the effects of an accident reduced by means of such a method. If, for example, the tilting of an office chair, in which the seat element is installed, is identified by the sensor, a reaction of the user which can prevent the tilting can be triggered by an impulse emitted by an actuator at a suitable point. If the sensor receives a signal for an imminent collision or a collision which is already occurring, for example from other sensors, if the seat element is installed in a vehicle seat, an individual actuator or a plurality of actuators can be activated by the control device in a targeted manner in order to move the user into a position by which the consequences of the accident are reduced, or in order to adjust to new requirements. These adaptations can also change over the course of time, so that the seat element can actively accompany a sequence of the collision.

Within the meaning of the present disclosure, an actuator is understood to mean an apparatus which comprises a clamping body and means for changing a position of the clamping body, wherein the position thereof can be changed manually or automatically.

Within the meaning of the present disclosure, a fluid is understood to mean a liquid or a gas. Preferably air is used as fluid within the meaning of the invention.

Further details of the present disclosure are described in the drawing with reference to schematically shown exemplary embodiments.

Figure 2:
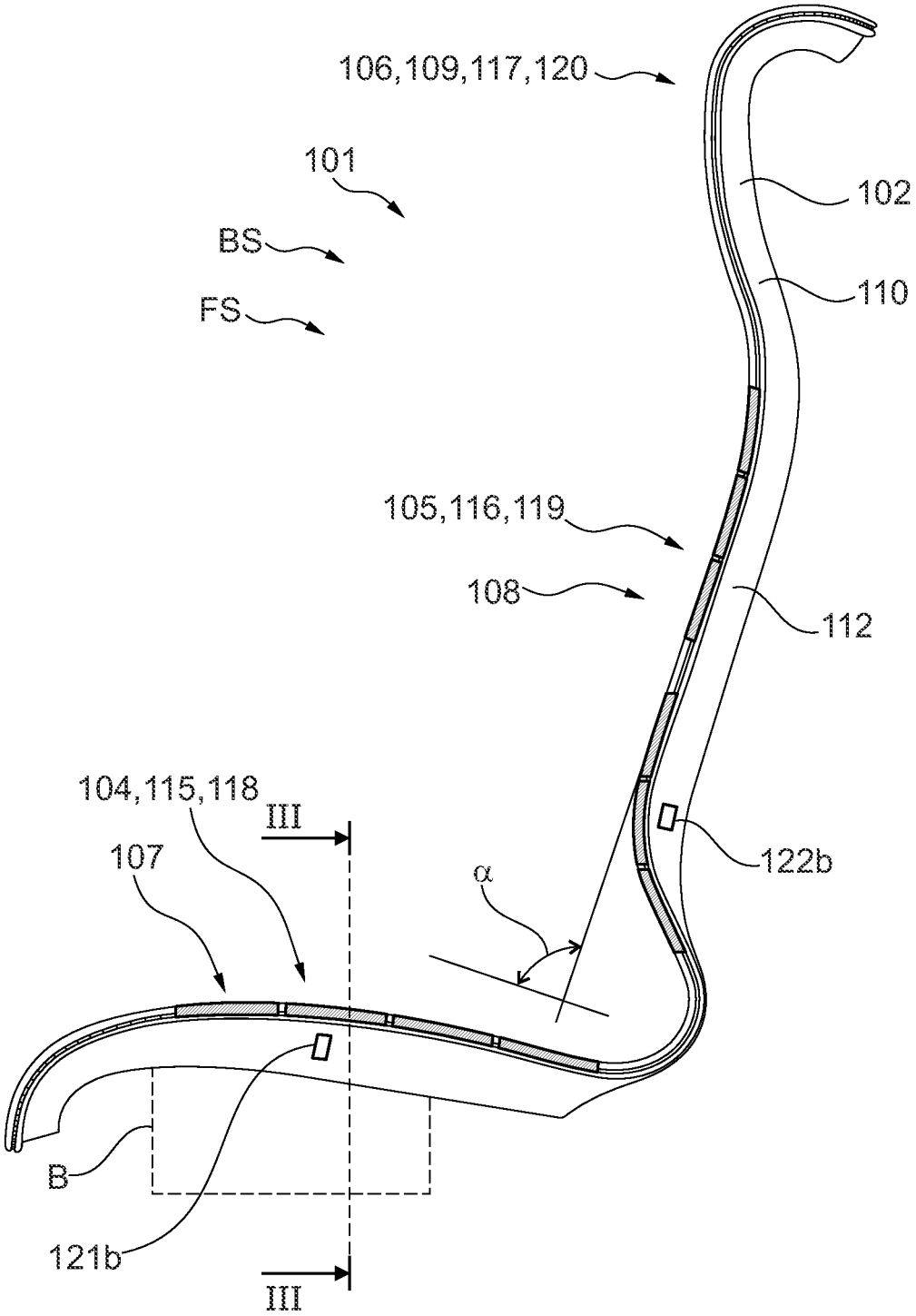
FIG. 2 shows the seat element shown in FIG. 1, in a side view.

In FIG. 1 and FIG. 2 a seat element 101 according to one example is shown in a perspective view and in a side view. The seat element 101 is generally supplemented by a base B which is indicated schematically in FIG. 2. The base B is formed, for example, by a rotary frame connected to the seat element 101, so that together with the seat element 101 this forms an office chair BS. It can also be provided that the base is formed by a slide connected to the seat element, so that together with the seat element this forms a vehicle seat FS which is mounted on a floor assembly of a vehicle.

The seat element 101 comprises a carrier frame 102 and schematically indicated supporting surfaces 104, 105, 106 which are configured as a seat surface 107, back surface 108 and headrest surface 109. The carrier frame 102 is configured as an annular closed profile ring 110 and comprises a left-hand sidepiece 111, a right-hand sidepiece 112, and a lower transverse piece 113 and an upper transverse piece 114. The sidepieces 111, 112 run, considered here in side view, in an approximately L-shaped manner so that the seat surface 107 and the back surface 108 are approximately at an angle $\alpha$ of 90° to one another. All three support surfaces 104, 105, 106 comprise in each case a cover element 115, 116, 117. Each cover element 115, 116, 117 comprises a fabric 118, 119, 120 and is supported on the left-hand sidepiece 111 and on the right-hand sidepiece 112.

The seat element also comprises actuators in the region of each of the three cover elements 115, 116, 117, wherein in the region of each supporting surface 104, 105, 106 by way of example only two actuators 121*a*, 121*b*, 122*a*, 122*b*, 123*a*, 123*b* are shown schematically in FIGS. 1 and 2.

Both the cover element 115 forming the seat surface 107 and the cover element 116 forming the back surface 108 comprise a plurality of strip-shaped portions 115*a*-115*d* and 116*a*-116*f* running between the left-hand sidepiece 11 and the right-hand sidepiece 112. Assigned to each strip-shaped portion are one or two actuators which, however, are indicated only for the strip-shaped portion 115*b* and for the strip-shaped portion 116*b* for maintaining the clarity of the figures. A corresponding configuration can also be provided in the region of the headrest surface 109.

Figure 3A:
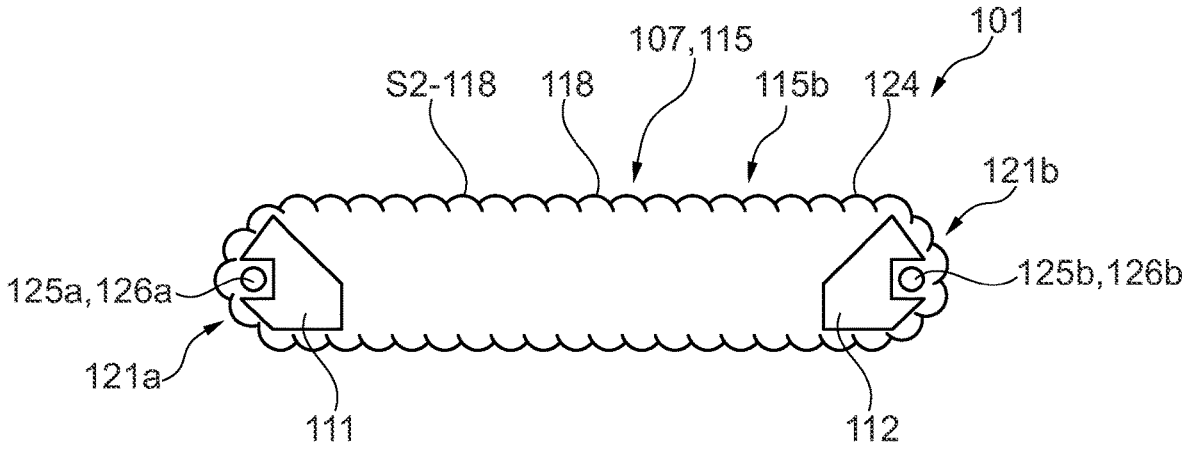
FIGS. 3*a* and 3*b* show a first specific variant of the seat element in a schematic perspective view and a schematic sectional view, as can be found in a section through the view of FIG. 2 corresponding to the cutting line III-III.
Figure 3B:
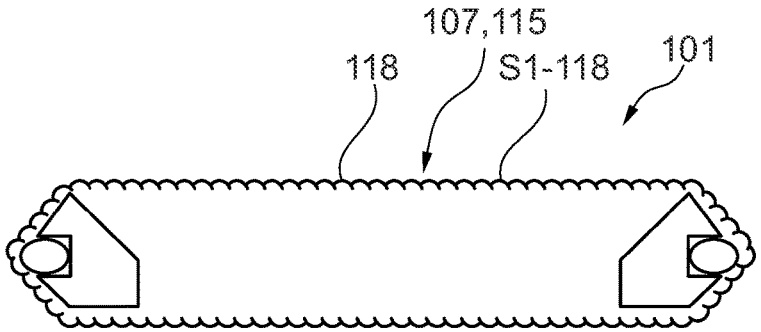

In FIGS. 3*a* and 3*b* a first specific variant of the seat element 101 is shown in a schematic perspective view and a schematic sectional view, as can be found in a section through the view of FIG. 2 corresponding to the cutting line III-III.

Here the cover element 115 forming the seat surface 107 is configured, at least in the region of its strip-shaped portion 115*b* which is visible in section, as a tubular casing 124 which spans the sidepieces 111, 112. The cover element forms a two-layer supporting device. The actuators 121*a*, 121*b* comprise in each case a hollow body 126*a*, 126*b*, as a clamping body 125*a*, 125*b*, which can be expanded by a fluid.

The cover element 115 is supported in the region of its strip-shaped portion 115*b* on the left-hand sidepiece 111 by means of the left-hand actuator 121*a* and on the right-hand sidepiece 112 by means of the right-hand actuator 121*b*. Here the support is implemented such that a level of tensioning S1-118 to which the fabric 118 of the cover element 115 is subjected when the actuators 121*a*, 121*b* are activated (see FIG. 3*b*) is greater than a level of tensioning S2-118 to which the fabric 118 of the cover element 115 is subjected when the actuators 121*a*, 121*b* are deactivated (see FIG. 3*a*).

Naturally, it is also provided to vary the degree of activation of the actuators 121*a*, 121*b*, so that the level of tensioning to which the fabric 118 of the cover element 115 is subjected can be adjusted steplessly by the user between the states "actuators not activated" and "actuators activated to a maximum degree".

When viewing FIGS. 1 and 2 together and the strip-shaped portions 115*a*-115*d* of the seat surface 107 shown therein, it can be seen that by equipping all of the strip-shaped portions 115*a*-115*d* with actuators, the cover element 115 can be tensioned differently in the region of the strip-shaped portions 115*a*-115*d* and, as a result, it is possible to adapt the seat element 101 individually to a user.

As can be seen from FIG. 1, the portions 115*a*-115*d* of the cover element 115 transition into one another, but in the region of the sidepieces 111, 112 of the carrier frame 102 they are supported with the carrier frame 102 by different actuators operating independently of one another.

The fabrics 118, 119, 120 of the seat element 101 form a continuous cover 127. Alternatively, however, this cover can also be interrupted so that the seat surface 107, the back surface 108 and the headrest surface 109 can be separated from one another. Naturally, it can also be provided that the strip-shaped portions 115*a*-115*d* and/or the strip-shaped portions 116*a*-116*f* are separated from one another transversely to the path of the sidepieces 111, 112.

The above embodiments of the seat surface 107 also apply equally to the cover element 116 forming the back surface 108 and the cover element 117 forming the headrest surface 109.

Figure 4A:
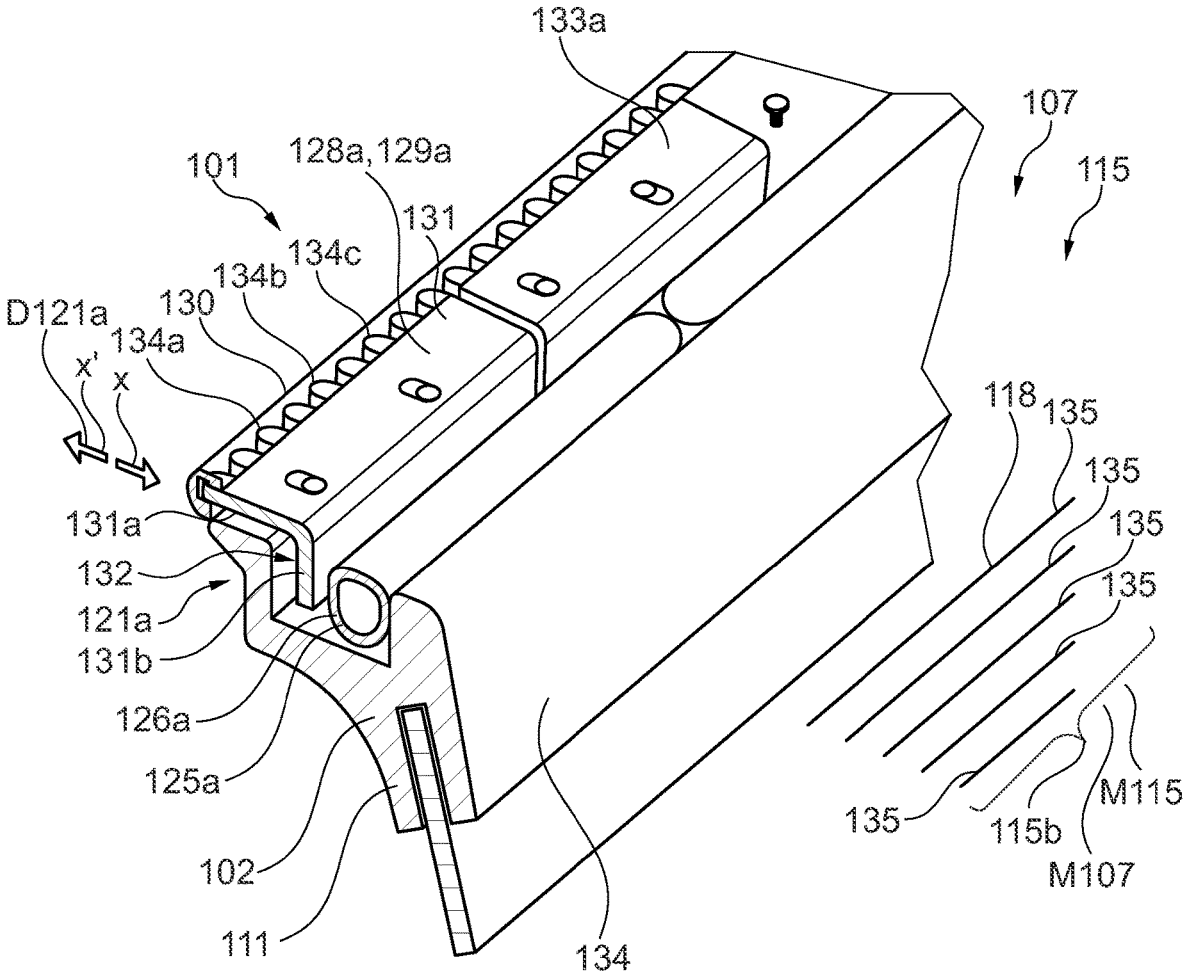
FIGS. 4*a* and 4*b* show a second specific variant of the seat element in a schematic perspective view and a schematic sectional view, as can be found in a section through the view of FIG. 1 corresponding to the cutting line IV-IV.
Figure 4B:
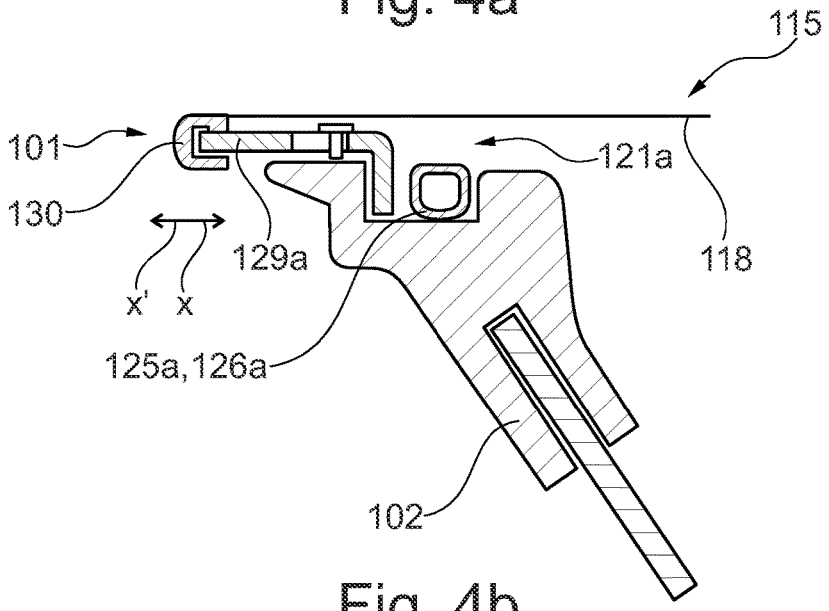

A second specific variant of the seat element 101 is schematically shown in FIGS. 4*a* and 4*b* in a perspective sectional view and in a right-angled sectional view corresponding to the cutting line IV-IV indicated in FIG. 1.

In the embodiment of FIGS. 4*a* and 4*b* the actuator 121*a* comprises a clamping body 125*a*, wherein the cover element 115 is connected to the clamping body 125*a*, which in turn is configured as a hollow body 126*a*, indirectly by the interposition of a force transmission element 128*a* which is configured as a clamping slide 129*a*. It is provided here that the actuator 121*a*, which comprises the clamping body 125*a* and the clamping slide 129*a*, pushes with a compressive force D121*a* onto an edge 130 of the cover element 115 for tensioning the fabric 118 of the cover element 115. This takes place indirectly via the clamping slide 129*a*, the cover element 115 being fastened thereto with its edge 130.

The clamping slide 129*a* is designed as an L-shaped angled portion, which is connected with a first limb 131*a* to the edge 130 of the cover element 115, which is guided on the carrier frame 102 transversely displaceably to a longitudinal extent of the carrier frame 102 and which is received with a second limb 131*b* in a recess 132 running in a channel-like manner along the carrier frame 102.

The clamping body 125*a* which is configured as a hollow body 126*a* is received in the channel-like recess 132. The hollow body 126*a* is arranged in the channel-like recess 132 on a side facing a center M107 of the seat surface 107, and the second limb 131*b* is positioned in the channel-like recess 132 on a side facing away from the center M107 of the seat surface 107. Accordingly, when the hollow body 126*a* expands, the clamping slide 129*a* is pushed away from the center M107 of the seat surface 107 in the direction of the arrow x' and also moves the edge 130 of the cover element 115 in this direction, such that the fabric 118 of the cover element 115 is tensioned and the clamped position shown in FIGS. 4*a* and 4*b* is adopted. The clamping force is generated here by the actuator 121*a*, while being supported on the left-hand sidepiece 111 of the carrier frame 102. The seat element 101 is configured in a comparable manner in the region of the right-hand sidepiece 112 (see FIG. 1), such that the fabric 118 is pushed apart in the directions x, x' when the actuators 121*a*, 121*b* are activated, and thereby tensioned.

From FIG. 4*a* it can be seen that the actuator 121*a* extends only over the strip-shaped portion 115*b*, followed by a further actuator, not denoted. It can also be seen in FIG. 4*a* that the actuator 121*a* additionally acts on a further clamping slide 133*a*, wherein the above-mentioned actuator, not denoted, also acts thereon. As a result, the edge 130 of the cover element 115, which is configured as a welt holding the fabric 118, is flexibly adapted to actuators which are activated to different degrees.

From FIG. 4*b* it can be seen to which extent the clamping slide 129*a* can be moved on the carrier frame 102 in the x'-direction or x-direction.

The embodiment shown in FIGS. 4*a* and 4*b* can also be implemented in the region of all of the actuators or can also be combined with the embodiment shown in FIGS. 3*a*, 3*b*, so that for example the embodiment of FIGS. 4*a* and 4*b* is provided for the seat surface 107 and the embodiment of FIGS. 3*a* and 3*b* is provided for the back surface 108 and the headrest surface 109.

In FIG. 4*a* a construction of the fabric 118 of the cover element 115 can also be seen. This fabric comprises a weft thread 134 which is repeatedly deflected in the edge 130 of the cover element 115 and thus runs to and fro between the left-hand sidepiece 111 and the right-hand sidepiece 112 (see FIG. 1). The fabric 118 of the cover element 115 also comprises warp threads 135 which run in the direction of the left-hand sidepiece 111 and the right-hand sidepiece 112. The weft thread 134 and the warp threads 135 are woven together in the conventional manner. In a central region M115 of the cover element 115 extending close to the edge 130, the weft thread 134 runs transversely to the warp threads 135. The weft thread 134 and the warp threads 135 are shown in each case schematically and by way of example.

From FIG. 4*a* it can be seen that the cover element 115 is connected to the actuator 121*a* by a plurality of path sections 134*a*, 134*b*, 134*c* of the at least one weft thread 134, the path sections 134*a*, 134*b*, 134*c* are received in the edge 130 of the cover element 115 which is configured as a welt, and this is connected to the clamping slide 129*a* of the actuator 121*a*.

In principle, the adjustment path by which the fabric of the cover element can be tensioned in one of the strip-shaped portions is initially dependent on whether a clamping body of an actuator is arranged on only one of the sidepieces or whether a clamping body of a first and second actuator is arranged in each case on both sidepieces. If a longer adjustment path is required or one of the two sidepieces is intended to be configured without a clamping body, this can be achieved by actuators arranged adjacent to one another on a sidepiece. To this end, the channel-like recess is widened and a clamping body of a first actuator and a clamping body of a second actuator are arranged in the recess. Naturally, an optionally present guide of an optionally present clamping slide, by which the clamping slide is guided on the carrier frame, then also has to be adapted to the longer adjustment path. Naturally, for further enlargement of the total adjustment path, such an enlargement of the adjustment path can also be carried out on both sidepieces in the region of a strip-shaped portion.

Figure 5A:
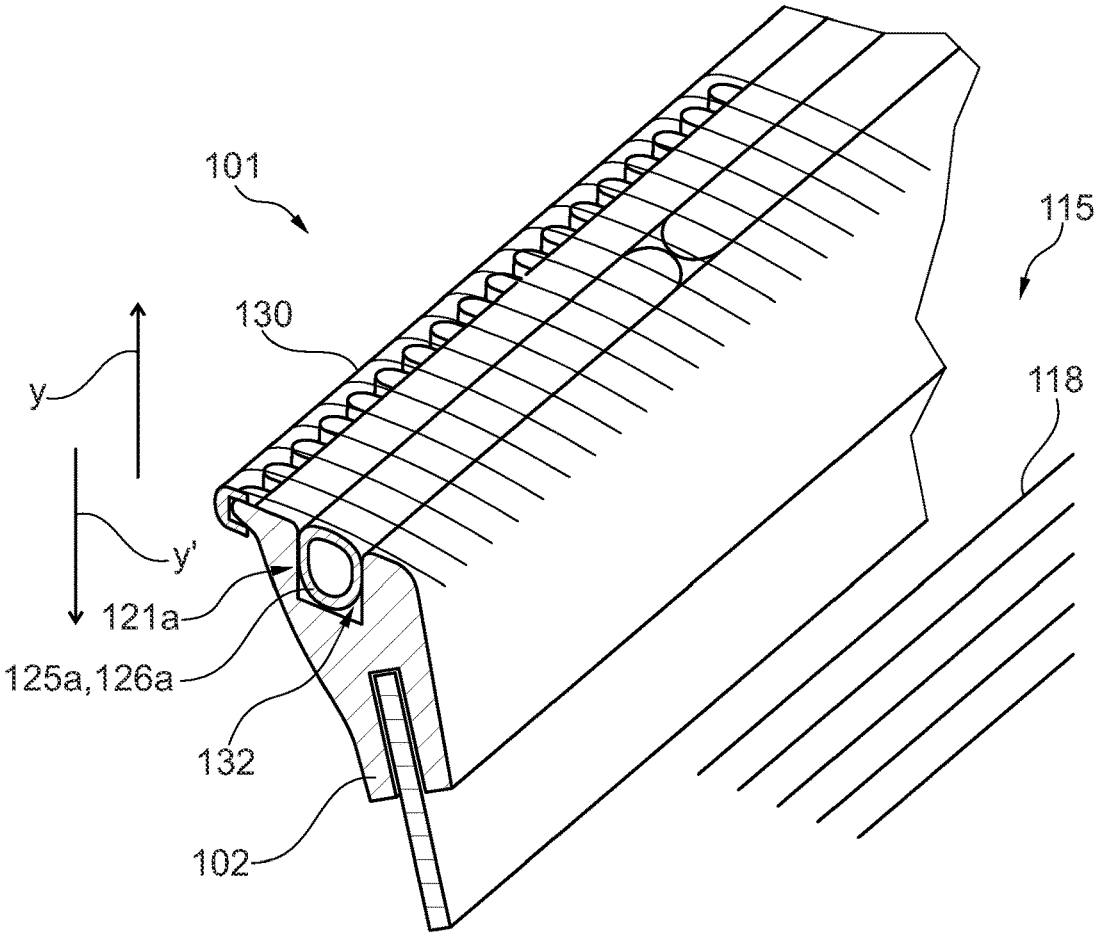
FIGS. 5*a* and 5*b* show a second specific variant of the seat element in a schematic perspective view and a schematic sectional view, as can be found in a section through the view of FIG. 1 corresponding to the cutting line V-V.
Figure 5B:
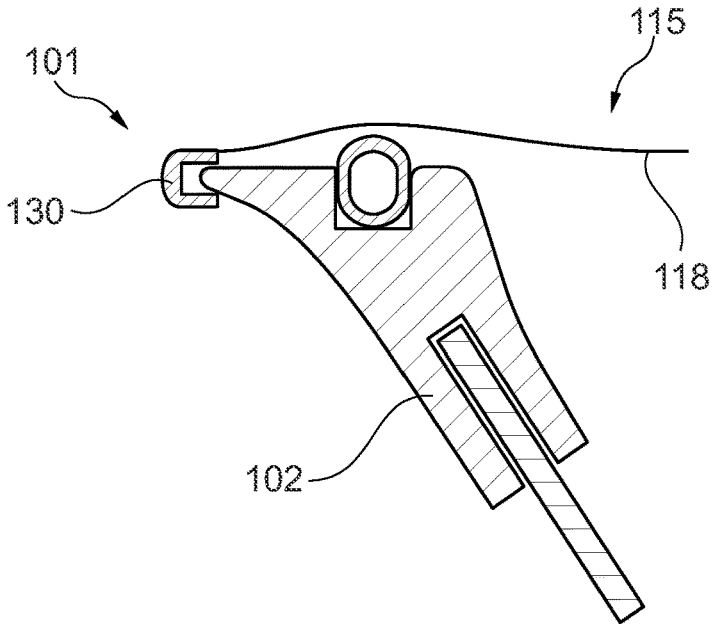

A third specific variant of the seat element 101 is shown schematically in FIGS. 5*a* and 5*b* in a perspective side view and in a right-angled sectional view corresponding to the cutting line V-V indicated in FIG. 1.

In the perspective sectional view of FIG. 5*a*, as in the second variant, a channel-like recess 132 which runs along the carrier frame 102 can be identified. In contrast to the second variant, no clamping slide is used in the third variant. Rather, the cover element 115 is stretched with an edge 130 directly onto the carrier frame 102, wherein the fabric 118 of the cover element 115 covers the channel-like recess 132 such that a clamping body 125*a* of the actuator 121*a*, which is also configured as a hollow body 126*a*, is enclosed below the fabric 118 in the channel-like recess 132. When the actuator 121*a* is active—as shown in FIGS. 5*a* and 5*b*—the hollow body 126*a* is then expanded in the y-direction such that it expands beyond the recess 132 and at the same time lifts the fabric 118 such that this fabric is tensioned to a greater extent than when the hollow body 126*a* is received entirely in the channel-like recess 132 when the actuator 121*a* has been deactivated.

In principle, in the third variant the actuator 121*a* is arranged and configured such that when the actuator 121*a* has been activated the cover element 115 is lifted further from the carrier frame 102, and when the actuator 121*a* has been deactivated the cover element is positioned on the carrier frame 102.

It is also provided to combine together the second and third variants shown in FIGS. 4*a* to 5*b*, such that both the second variant and the third variant are implemented on at least one of the two sidepieces in at least one of the strip-shaped portions of a seat element for influencing the membrane of the cover element. To this end, the sidepiece 111, shown in FIG. 4*a* to the right adjacent to the recess 121*a*, has a further recess which runs parallel thereto and in which the clamping body shown in FIG. 5*a* is inserted such that it runs below the membrane of the cover element, as shown in FIG. 5*a*. Accordingly, the membrane can now be tensioned in the x-direction and/or lifted in the y-direction as a function of an activation of the actuators for the two clamping bodies. It is provided to design the seat element on the opposing sidepiece accordingly, such that a lifting and a lowering of a user, and alternatively a rocking movement of the user to the left or right, can be achieved by a corresponding control of the actuators, in addition to a tensioning of the membrane. If a plurality of adjacent strip-shaped portions are correspondingly configured, a tilting movement of the user to the front or rear can also be achieved by a corresponding activation of the actuators. The actuator according to the second variant is naturally not necessarily required for achieving a tilting and rocking effect on the user, but the tilting and rocking effect on the user can be reinforced thereby with a corresponding activation thereof.

Figure 6:
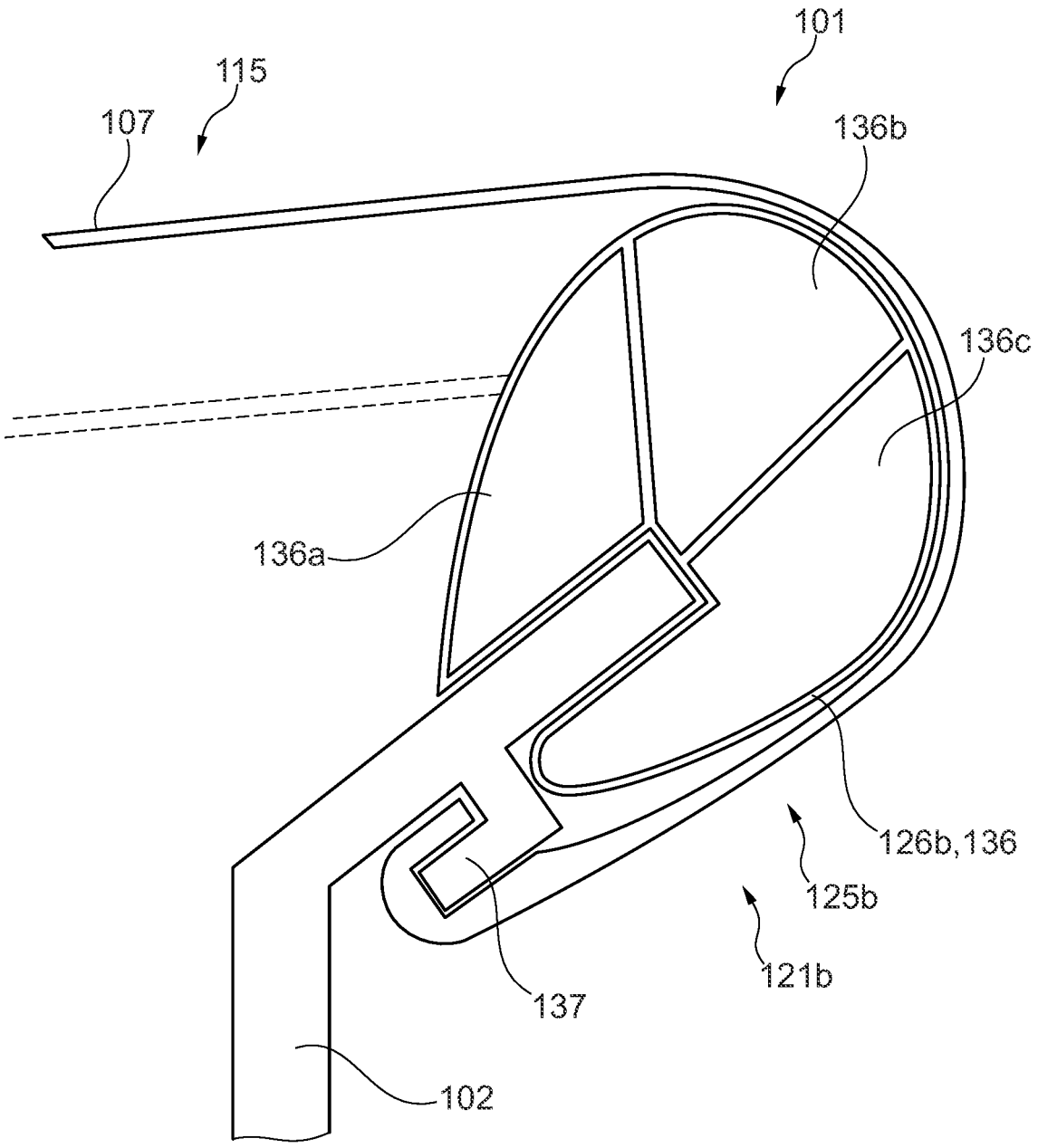
FIG. 6 shows a fourth specific variant in a schematic sectional view.

A fourth specific variant of the seat element 101 is shown schematically in FIG. 6 in a schematic sectional view corresponding to the cutting line VI-VI indicated in FIG. 1.

The actuator 121*b* comprises a hollow body 126*b* as a clamping body 125*b*, which is configured as a multi-chamber tube 136. A tensioning of the cover element 115 is effected here by a deformation of the cover element 115, which is generated by all of the chambers 136*a*-136*c* of the multi-chamber tube 136 being filled with a fluid. The cover element 115 is lifted from the carrier frame 102 when the actuator 121*b* has been activated further than the cover element 115 is lifted from the carrier frame 102 when the actuator 121*a* has been deactivated.

Indicated by dashed lines is a position of the seat surface 107 which is formed by the cover element 115 and which results when the multi-chamber tube 136 is not completely filled, as in the drawing, but a smaller quantity of fluid is filled, in particular, in the chambers 136*a* and 136*b*.

The cover element 115 in turn comprises the fabric 118 and an edge 130 which is configured as a welt. For fastening the edge 130, the carrier frame 102 comprises a rib 137.

It is also provided that the chambers of the multi-chamber tube change in terms of cross section over the longitudinal extent thereof, such that when the actuator has been activated the multi-chamber tube is changed differently in terms of volume over the length thereof. In this manner, the multi-chamber tube can be adapted to the requirements in the individual strip-shaped portions. Thus it is not necessary, for example, to arrange a plurality of actuators adjacent to one another in the seat region but one actuator which extends over all of the strip-shaped portions of the seat region is sufficient.

Although the present invention has been described with reference to preferred embodiments, workers skilled in the art will recognize that changes may be made in form and detail without departing from the spirit and scope of the invention.

LIST OF REFERENCE SIGNS

101 seat element
102 Carrier frame
103 Not assigned
104-106 Supporting surface
107-109 Seat surface, back surface, headrest surface
110 Annular closed profile ring
111, 112 Left-hand, right-hand sidepiece
113, 114 Lower, upper transverse piece
115-117 Cover element
115*a*-115*d* Strip-shaped portion of 115
116*a*-116*f* Strip-shaped portion of 116
118-120 Fabric
121*a*-121*b* Actuator
122*a*-122*b* Actuator
123*a*, 123*b* Actuator
124 Tubular casing
125*a*, 125*b* Clamping body of 121*a*, 121*b*
126*a*, 126*b* Hollow body
127 Covering formed by 118-120
128*a* Force transmission element of 121*a*
129*a* Clamping slide
130 Edge of 115
131 Angled portion formed by 129*a*
131*a* First limb of 131
131*b* Second limb of 131
132 Channel-like recess in 102
133*a* Further clamping slide
134 Weft thread
134*a*-134*c* Path section of 134
135 Warp thread
136 Multi-chamber tube
136*a*-136*c* Chamber of 136
137 Rib on 102
B Base
BS Office chair
D121*a* Compressive force of 121*a*
FS Vehicle seat
KE Control device
M107 Center of seat surface
M115 Central region of 115
S1-118 Level of tensioning of 118 when the actuator has been activated
S2-118 Level of tensioning of 118 when the actuator has been deactivated
SE Sensor device
x, x' Direction of arrow
y, y' Direction of arrow

The invention claimed is:

1. A seat element comprising:
a carrier frame, and
supporting surfaces,
wherein the carrier frame comprises a left-hand sidepiece and a right-hand sidepiece,
wherein the supporting surfaces are configured as a seat surface and a back surface,
wherein at least one supporting surface, of the supporting surfaces, comprises a cover element,
wherein the cover element comprises a fabric and is supported on the left-hand sidepiece and on the right-hand sidepiece of the carrier frame,
wherein the seat element comprises actuators,
wherein the cover element is supported on the left-hand sidepiece and/or on the right-hand sidepiece by at least one actuator, of the actuators, such that a level of tensioning to which the fabric of the cover element is subjected when the at least one actuator has been activated is greater than a level of tensioning to which the fabric of the cover element is subjected when the at least one actuator has been deactivated, and
wherein the cover element is connected to the at least one actuator by a plurality of path sections of at least one weft thread.

2. The seat element as claimed in claim 1, wherein the fabric of the cover element comprises the at least one weft thread and warp threads, wherein the warp threads run in the direction of the left-hand sidepiece and the right-hand sidepiece and wherein the at least one weft thread runs transversely to the warp threads in a central region of the cover element.

3. The seat element as claimed in claim 1, wherein at least one of:
the cover element is configured as a single-layer supporting device, or
the cover element is configured as a two-layer supporting device having an upper layer and a lower layer, wherein the upper layer and the lower layer are spaced apart from one another between the left-hand sidepiece and the right-hand sidepiece, such that a cavity is formed between the upper layer and the lower layer and the cover element is configured as a tubular casing.

4. The seat element as claimed in claim 1, wherein the actuators are arranged:
exclusively on the left-hand sidepiece,
exclusively on the right-hand sidepiece,
on both the right-hand sidepiece and the left-hand sidepiece, or
spaced apart from the right-hand sidepiece and the left-hand sidepiece.

5. The seat element as claimed in claim 1, wherein the actuators comprise clamping bodies, and wherein at least one of:
the clamping bodies of at least two actuators are arranged adjacent to one another such that each clamping actions of each clamping body, of the clamping bodies of the at least two actuators, are oriented in the same direction and are added together, or
the clamping bodies of at least two actuators are arranged adjacent to one another such that each clamping actions of each clamping body, of the clamping bodies of the at least two actuators, are oriented in different directions and are superimposed.

6. The seat element as claimed in claim 1, wherein the cover element comprises a plurality of portions running in a strip-shaped manner between the left-hand sidepiece and the right-hand sidepiece, and wherein at least two portions, of the plurality of portions are assigned to respective actuators, of the actuators.

7. A seat element comprising:

a carrier frame, and supporting surfaces, wherein the carrier frame comprises a left-hand sidepiece and a right-hand sidepiece, wherein the supporting surfaces are configured as a seat surface and a back surface, wherein at least one supporting surface, of the supporting surfaces, comprises a cover element, wherein the cover element comprises a fabric and is supported on the left-hand sidepiece and on the right-hand sidepiece of the carrier frame, wherein the seat element comprises actuators, wherein the cover element is supported on the left-hand sidepiece and/or on the right-hand sidepiece by at least one actuator, of the actuators, such that a level of tensioning to which the fabric of the cover element is subjected when the at least one actuator has been activated is greater than a level of tensioning to which the fabric of the cover element is subjected when the at least one actuator has been deactivated, wherein the at least one actuator comprises a clamping body, wherein the cover element is either directly connected to the clamping body or is indirectly connected by an interposition of a force transmission element which is configured as a clamping slide, and wherein at least one of:

the at least one actuator pushes with a compressive force onto the cover element for clamping the cover element, or the at least one actuator pulls with a tensile force on the cover element.

8. The seat element as claimed in claim 7, wherein the force transmission element and the at least one actuator, are received on the left-hand sidepiece and in a recess of the left-hand sidepiece or on the right-hand sidepiece and in a recess of the right-hand sidepiece, and wherein a clamping force is generated thereby on the cover element that is supported on the left-hand sidepiece or the right-hand sidepiece.

9. The seat element as claimed in claim 8, wherein the force transmission element is guided in a linearly displaceable manner on the left-hand sidepiece or on the right-hand sidepiece.

10. A seat element comprising:

a carrier frame, and supporting surfaces, wherein the carrier frame comprises a left-hand sidepiece and a right-hand sidepiece, wherein the supporting surfaces are configured as a seat surface and a back surface, wherein at least one supporting surface, of the supporting surfaces, comprises a cover element, wherein the cover element comprises a fabric and is supported on the left-hand sidepiece and on the right-hand sidepiece of the carrier frame, wherein the seat element comprises actuators, wherein the cover element is supported on the left-hand sidepiece and/or on the right-hand sidepiece by at least one actuator, of the actuators, such that a level of tensioning to which the fabric of the cover element is subjected when the at least one actuator has been activated is greater than a level of tensioning to which the fabric of the cover element is subjected when the at least one actuator has been deactivated, and wherein;

at least one actuator, of the actuators, comprises a resilient hollow body which can be changed in terms of shape by supplying or draining off a fluid, and/or at least one actuator, of the actuators, comprises a single eccentric or a double eccentric which can be adjusted by hand and/or automatically, and/or at least one actuator, of the actuators, comprises a spindle which can be adjusted by hand or automatically.

11. The seat element as claimed in claim 1, wherein a tensioning of the cover element is generated by a tensile force or a compressive force which runs in a plane defined by the cover element and/or that a tensioning of the cover element is generated by a deformation of the cover element.

12. The seat element as claimed in claim 1, wherein the seat element comprises a further supporting surface which is configured as a headrest surface.

13. The seat element as claimed in claim 1, wherein the carrier frame, which forms the right-hand sidepiece and the left-hand sidepiece for the supporting surfaces, is configured as a one-piece carrier frame, and wherein the carrier frame is configured as an annular closed profile ring, the right-hand sidepiece and the left-hand sidepiece thereof being connected by a lower transverse piece and an upper transverse piece.

14. A seat element comprising:

a carrier frame, and supporting surfaces, wherein the carrier frame comprises a left-hand sidepiece and a right-hand sidepiece, wherein the supporting surfaces are configured as a seat surface and a back surface, wherein at least one supporting surface, of the supporting surfaces, comprises a cover element, wherein the cover element comprises a fabric and is supported on the left-hand sidepiece and on the right-hand sidepiece of the carrier frame, wherein the seat element comprises actuators, wherein the cover element is supported on the left-hand sidepiece and/or on the right-hand sidepiece by at least one actuator, of the actuators, such that a level of tensioning to which the fabric of the cover element is subjected when the at least one actuator has been activated is greater than a level of tensioning to which the fabric of the cover element is subjected when the at least one actuator has been deactivated, wherein the at least one actuator, when deactivated, is configured to position the cover element in a first position relative to the carrier frame, wherein at least one actuator, when activated, is configured to position the cover element in a second position relative to the carrier frame, and wherein the cover element is lifted further from the carrier frame in the second position than in the first position.

15. The seat element as claimed in claim 1, wherein the seat element forms a seat element of an office chair or a vehicle seat, and wherein a flexible zone is formed between the seat surface and the back surface by the left-hand sidepiece and the right-hand sidepiece.

16. The seat element as claimed in claim 1, wherein the seat element comprises a control device for the actuators and a sensor device, wherein the control device activates at least one actuator, of the actuators, in response to a signal from the sensor device after a predetermined time and for a predetermined time period.

17. A method for operating a seat element, wherein the seat element comprises a plurality of actuators, a control device for the plurality of actuators, a sensor device, a carrier frame, and supporting surfaces, wherein the carrier frame comprises a left-hand sidepiece and a right-hand sidepiece, wherein the supporting surfaces are configured as a seat surface and a back surface, wherein at least one supporting surface, of the supporting surfaces, comprises a cover element, wherein the cover element comprises a fabric and is supported on the left-hand sidepiece and on the right-hand sidepiece of the carrier frame, wherein the cover element is supported on the left-hand sidepiece and/or on the right-hand sidepiece by at least one actuator, of the plurality of actuators, such that a level of tensioning to which the fabric of the cover element is subjected when the at least one actuator has been activated is greater than a level of tensioning to which the fabric of the cover element is subjected when the at least one actuator has been deactivated, wherein the method comprises:

activating the control device with a signal from the sensor device such that, after a predetermined time and for a predetermined time period, one or more actuators, of the plurality of actuators, are activated thereby for achieving a deformation of the fabric of the cover element of the seat element.

18. The method of claim 17, and further comprising:

activating the one or more actuators at the same time, or activating the one or more actuators one after the other.

19. The seat element as claimed in claim 1, wherein at least one of:

the at least one actuator pushes with a compressive force onto an edge of the cover element, or the at least one actuator pulls with a tensile force on the edge of the cover element.

* * * * *